US006361274B1

(12) United States Patent
Kreis et al.

(10) Patent No.: US 6,361,274 B1
(45) Date of Patent: Mar. 26, 2002

(54) FASTENING DEVICES FOR HEAT-PROTECTION SHIELDS

(75) Inventors: Erhard Kreis, Otelfingen; Christoph Nagler, Zürich; Ulrich Rathmann, Nussbaumen, all of (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/632,795

(22) Filed: Aug. 4, 2000

(30) Foreign Application Priority Data

Aug. 9, 1999 (DE) ..... 199 36 761

(51) Int. Cl.[7] ..... F03B 11/00
(52) U.S. Cl. ..... 415/173.1
(58) Field of Search ..... 415/173.1, 134, 415/135, 136, 137, 138, 139, 174.2

(56) References Cited

U.S. PATENT DOCUMENTS

| | | | | |
|---|---|---|---|---|
| 4,405,284 A | | 9/1983 | Albrecht et al. | 415/174 |
| 4,784,569 A | * | 11/1988 | Sidenstick | 415/174 |
| 5,083,424 A | | 1/1992 | Becker | 60/39.31 |

FOREIGN PATENT DOCUMENTS

| | | |
|---|---|---|
| DE | 3045224 C2 | 6/1981 |
| DE | 3316535 C2 | 11/1984 |
| GB | 2075659 A | 11/1981 |

* cited by examiner

*Primary Examiner*—Edward K. Look
*Assistant Examiner*—Richard Edgar
(74) *Attorney, Agent, or Firm*—Burns, Doane, Swecker & Mathis, L.L.P.

(57) ABSTRACT

A fastening device for a heat-protection shield of a gas turbine is provided with a center mounting element which has a defined installation clearance with a mounting slot in the radial direction. In the normal operating state, this mounting element has no function, such that thermal differential expansions in the radial direction between the heat-protection shield and its counterpart are possible without impairment within the limits of this defined clearance. The mounting element does not start to bear against the counterpart until the radial differential expansion exceeds the size s. The deformation of the heat-protection shield toward a component moving in a relative manner is thus limited and excessive grazing of the components against one another is avoided.

4 Claims, 2 Drawing Sheets

FASTENING DEVICES FOR HEAT-PROTECTION SHIELDS

FIELD OF THE INVENTION

The invention relates to a fastening device for heat-protection shields. More particularly, the invention relates to a fastening device for fastening heat-protection shields in a turbo machine.

BACKGROUND OF THE INVENTION

Heat-protection shields are used in thermal turbomachines, such as gas turbines for example. They are arranged there in the axial direction between the blade rows and protect the rotor or the casing from direct contact by hot gas.

During operation, these components must absorb considerable thermal differential expansions with the component to which they are fastened, as a result of which they are deformed in the radial and axial directions. On the other hand, heat-protection shields, in the installed state, have only very small clearance relative to the blades opposite them. On account of the deformation and the small clearance, however, there is the risk of the blades grazing against the heat-protection shield. This results in a further heat input and in a positive reaction via a greater deformation and even more violent grazing. Under unfavorable conditions, this may lead to serious damage to a machine. However, the heat-protection shield must be allowed a certain clearance in its mountings, since impaired thermal expansions otherwise lead to high component internal stresses and finally to a drastic reduction in the service life of the heat-protection shield. Accordingly, according to the prior art, the well-known latent risk of damage due to the grazing of a component moving in a relative manner against a heat-protection shield has to be tolerated.

SUMMARY OF THE INVENTION

The intention of the invention is to provide a remedy here. The object of the invention, as characterized in the claims, is to permit deformations in a heat-protection shield to a certain extent in order to compensate for thermal expansions but to definitely limit in particular radial deformations to a well-defined size.

The essence of the invention is therefore to fix a heat-protection shield in the casing or to the shaft of a turbomachine by means of mounting elements situated axially on the outside and, by means of additional mounting elements arranged between the latter, to provide a safety device for absorbing excessive radial deformations. In every axial section of the heat-protection shield, in each case only one mounting element performs an axial fixing function, whereas the other mounting elements permit an unimpaired axial deformation of the heat-protection shield. Furthermore, the heat-protection shield in axial section is fixed in the radial direction by the mounting elements situated furthest on the outside. The radial mounting of the heat-protection shield at two points far away from one another improves the tilting stability of the mounting on the one hand. On the other hand, the axial overhang of the heat-protection shield is minimized, as a result of which vibrations of the heat-protection shield are best prevented. Arranged in the axial direction between the radially bearing mounting elements are further mounting elements which have a radial clearance in their fastening slots and have no bearing function during normal operation. This mounting element is given a bearing function and prevents the occurrence of an excessive radial deformation only when a radial deformation of the heat-protection shield exceeds the size of the radial clearance where one of these mounting elements is arranged with this clearance.

BRIEF DESCRIPTION OF THE DRAWINGS

The invention is explained in more detail below with reference to an exemplary embodiment shown in the drawing. In detail.

DETAILED DESCRIPTION OF THE INVENTION

Figure 1:
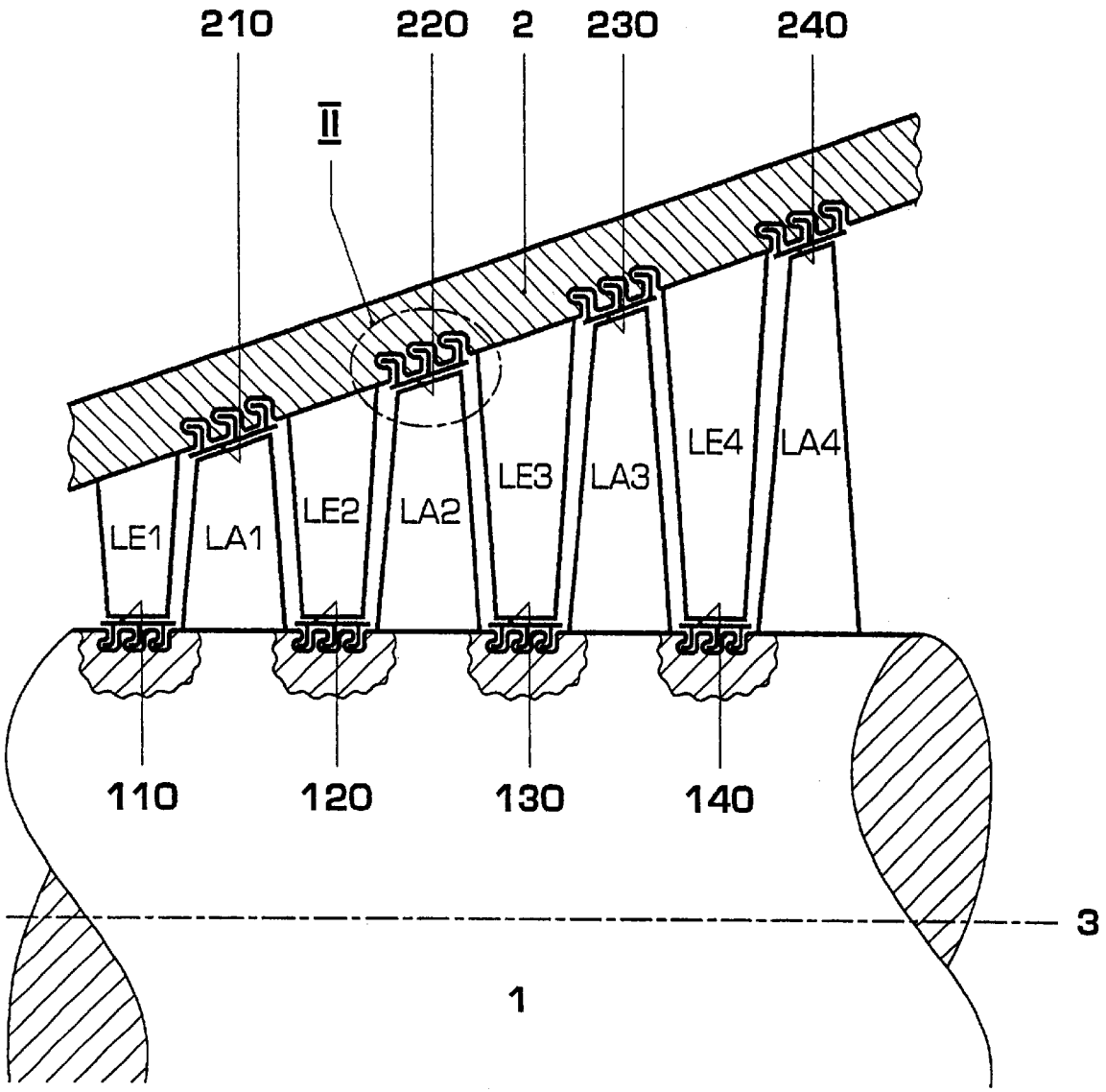
FIG. 1 shows a longitudinal section through a part of a gas turbine.

An axial section through a four-stage turbine of a gas turboset is shown in FIG. 1. During operation the shaft 1 rotates about the turbine axis 3. The moving blades LA1 to LA4 are arranged on the shaft 1. The associated guide blades LE1 to LE4 are fastened in the casing 2. Opposite the guide-blade tips, the rotor heat-protection shields 110, 120, 130 and 140 are fastened to the rotor by suitable fastening means. Similarly, opposite the moving-blade tips, the casing heat-protection shields 210, 220, 230 and 240 are fastened to the casing in a suitable manner. In this arrangement, in reality, heat-protection shields will not necessarily be found in every turbine stage; these heat-protection shields will often be dispensed with in practice especially in the last stages, in which the working medium has already expanded and cooled down to a considerable extent. On the other hand, the use of heat-protection shields with the fastening device according to the invention is by no means restricted to the turbine of a gas turboset. The invention may also be advantageously used, for example, in steam turbines or in turbocompressors, and in this case especially in the high-pressure stages of modern turbocompressors.

Figure 2:
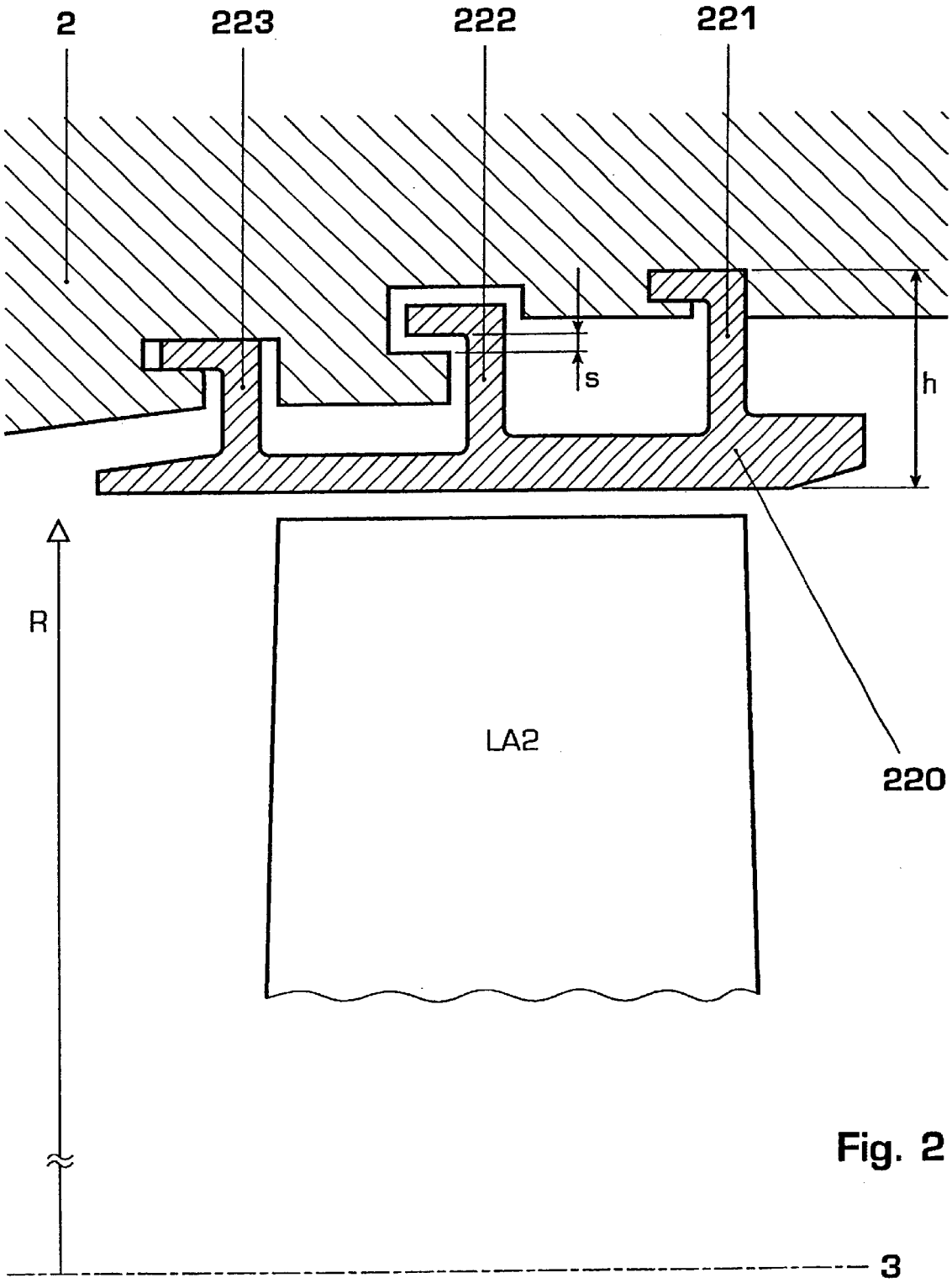
FIG. 2 shows the surroundings of a heat-protection shield fitted in this gas turbine.

The immediate surroundings of the casing heat-protection shield 220 of the second turbine stage are shown enlarged in FIG. 2. In particular, the fastening of the heat-protection shield 220 in the casing 2 by means of three mounting elements 221, 222, 223 can easily be seen, the mounting elements 221, 222, 223 being designed as hooks and in each case lying in associated casing slots. In the direction of the machine longitudinal axis 3, the heat-protection shield is only fixed by the mounting element 221, whereas the mounting elements 222 and 223 lie with axial clearance in the associated slots. In the radial direction, indicated by R, the mounting elements 221 and 223 are anchored free of clearance in their casing slots. In the radial direction, the heat-protection shield 220 is therefore fixed in the casing by the two axially outer mounting elements 221 and 223. The mounting element 222, on the other hand, has both axial and radial clearance in its casing slot and performs no fastening function in the normal operating state.

During operation, the heat-protection shield 220 is heated to a considerable degree, and thermal differential expansions occur in the axial and radial directions both toward the moving blade LA2 and the casing 2. For this reason, in particular the clearance of the mounting element 222 in its fastening slot is important, since an impaired expansion would induce high internal stresses in the heat-protection shield 220, a factor which would ultimately lead to a great reduction in the service life of the component. Although radial deformations away from the tip of the opposite blade lead to increased gap losses and a lower efficiency of the machine, they do not at first put the operational reliability at risk. On the other hand, radial deformations toward the opposite blade tip have the potential to cause considerable damage to a machine: as soon as a part opposite the heat-protection shield starts to graze against the heat-protection shield, additional heat is fed into the heat-protection shield by the friction, as a result of which the deformation and thus the friction in turn increases. Therefore the radial clearance of the mounting element 222 in its fastening slot toward the opposite blade tip is limited to a size s, which is advantageously selected to be less than 20% of the size h and of course less than the clearance between the blade and the heat-protection shield. If, in exceptional situations, the radial deformation of the heat-protection shield therefore exceeds the radial clearance of the center mounting element—in principle a plurality of mounting elements may also be arranged with clearance in the associated fastening slot between the mounting elements lying axially on the outside—the center mounting element starts to bear in the radial direction and in this way prevents an excessive radial deformation of the heat-protection shield.

Although this invention has been illustrated and described in accordance with certain preferred embodiments, it is recognized that the scope of this invention is to be determined by the following claims.

What is claimed is:

1. A fastening device for fastening heat-protection shields in a turbomachine, such that the heat-protection shields are fixed in a radial and an axial mounting position, said fastening device comprising:

a plurality of mounting elements said mounting elements being arranged in at least three different axial mounting positions on the heat-protection shield, wherein said mounting elements engage in fastening slots of a shaft or a casing of the turbomachine, when in an installed state, and wherein the mounting elements which lie axially furthest on the outside of said heat-protection shield are arranged free of clearance in the fastening slots in the radial direction in the installed state, and the mounting elements which are arranged axially between said axially furthest lying mounting elements have a radial clearance in the fastening slot.

2. The fastening device as claimed in claim 1, wherein the mounting elements are designed as hooks.

3. The fastening device as claimed in claim 1, wherein the radial clearance is less than 20% of a size h, the size h being the size from a side of the beat-protection shield over which hot gas flows during operation up to a point of a mounting element which is furthest away from said side.

4. The fastening device as claimed in claim 1, wherein the radial clearance is between 0.1 mm and 5 mm.

* * * * *